US011603596B2

(12) United States Patent
Henry et al.

(10) Patent No.: US 11,603,596 B2
(45) Date of Patent: Mar. 14, 2023

(54) ELECTROLYTIC CELL FOR HYPOCHLORITE GENERATION

(71) Applicant: Electrichlor, LLC, Laramie, WY (US)

(72) Inventors: Kent Douglas Henry, Laramie, WY (US); Malcolm Barrie Bentley, Las Vegas, NV (US)

(73) Assignee: Electrichlor, LLC, Laramie, WY (US)

( * ) Notice: Subject to any disclaimer, the term of this patent is extended or adjusted under 35 U.S.C. 154(b) by 113 days.

(21) Appl. No.: 16/817,404

(22) Filed: Mar. 12, 2020

(65) Prior Publication Data

US 2020/0291534 A1 Sep. 17, 2020

Related U.S. Application Data

(60) Provisional application No. 62/818,544, filed on Mar. 14, 2019.

(51) Int. Cl.

| | |
|---|---|
| ***C25B 1/26*** | (2006.01) |
| ***C25B 15/02*** | (2021.01) |
| ***C25B 15/08*** | (2006.01) |
| ***C25B 9/17*** | (2021.01) |
| ***C25B 9/70*** | (2021.01) |

(52) U.S. Cl.

CPC ..... *C25B 1/26* (2013.01); *C25B 9/17* (2021.01); *C25B 9/70* (2021.01); *C25B 15/02* (2013.01); *C25B 15/08* (2013.01)

(58) Field of Classification Search

CPC .... C25B 1/26; C25B 9/70; C25B 9/17; C25B 15/02; C25B 15/08

See application file for complete search history.

(56) References Cited

U.S. PATENT DOCUMENTS

| | | | | |
|---|---|---|---|---|
| 3,975,247 | A * | 8/1976 | Stralser | C02F 1/46104 205/701 |
| 4,151,052 | A * | 4/1979 | Goto | C25B 1/26 204/241 |
| 4,248,690 | A * | 2/1981 | Conkling | C25B 9/70 204/268 |
| 5,858,185 | A * | 1/1999 | Christian | C25B 9/00 204/272 |
| 2007/0007145 | A1* | 1/2007 | Simmons | G01N 1/2035 205/357 |
| 2014/0174942 | A1* | 6/2014 | Wylie | C25B 15/02 205/342 |
| 2016/0044926 | A1* | 2/2016 | Peters | A01N 59/00 205/335 |

* cited by examiner

*Primary Examiner* — Ciel P Contreras

(74) *Attorney, Agent, or Firm* — Holzer Patel Drennan

(57) ABSTRACT

An electrolytic cell, including a plurality of electrodes arranged to define a plurality of channels between adjacent electrodes is disclosed. Each channel is in fluid communication adjacent a first end with a first adjacent channel and is in fluid communication adjacent to a second end with a second adjacent channel. The electrolytic cell may be optimized for high concentration output of hypochlorite. The electrolytic cell may be used in conjunction with a plurality of cells operated collectively to provide operational efficiencies as compared to traditional hypochlorite generators.

19 Claims, 16 Drawing Sheets

ELECTROLYTIC CELL FOR HYPOCHLORITE GENERATION

TECHNICAL FIELD

This disclosure generally relates to the generation of hypochlorite. More specifically, this disclosure relates to improved means for generating hypochlorite from saltwater via electrolysis.

BACKGROUND

In-line chlorinated cooling systems are commonly used in industrial plants and power stations throughout the world by using seawater or adding sodium chloride (NaCl) to freshwater. For these systems, sodium hypochlorite is derived from the chloride ion in seawater or salinized water when it is passed through one or more electrolytic cells of a hypochlorite generator. Generally, sodium hypochlorite is produced by hypochlorite generators situated close to the cooling water intake structures of industrial plants and power stations to inject sodium hypochlorite into the cooling water system.

One object for injecting sodium hypochlorite into the industrial water systems is to keep algae, mussel, or other growth from clogging heat exchangers and generator condensers in order to keep plant efficiency at a maximum. If heat exchangers and condensers are allowed to build up with plant, muscle, or other growth, the rate of heat exchange becomes inefficient and machinery and equipment can overheat and break down. For this reason, it is imperative to keep the cooling water free from any growth that could impede the flow of water in cooling water systems.

In-line sodium hypochlorite generators receive a supply of salty water, either directly from a body of saltwater or from freshwater salinized with sodium chloride, to generally achieve a chloride concentration of about 19,000 mg/liter of Cr. The saltwater is circulated through one or more electrolytic cells to generate a sodium hypochlorite solution of up to 8,000 mg/liter. Dilute seawater from estuaries or other locations is usable, provided the dilution with freshwater is not excessive and the application can be satisfied using a lower concentration of sodium hypochlorite with or without additional electrolytic cells.

When saltwater is passed between an inert anode and cathode electrolyzed with a DC voltage, sodium hypochlorite is evolved at the positive anode and gaseous hydrogen at the negative cathode.

Inline hypochlorite generators using seawater or salinized water can become inefficient due to calcium and magnesium deposits on the cathode. In turn, a periodic flush through-cleaning must be used to keep the cell operating efficiently. Flushing with dilute hydrochloric acid, or other low pH solution, is employed to clean the cell and maximize the efficiency. However, such flushing operations result in downtime of the hypochlorite generators, which may disrupt operations of the systems to which hypochlorite from the generators are provided.

In this regard, previously proposed electrolytic cells suffer from a number of disadvantages. Among these disadvantages are inefficiencies due to the cell design and the considerable physical size of the cell, which means that material costs are high and a substantial support structure is required, together with a greater quantity of copper or aluminum bus bars. This also has the effect that the cost of erection and transport is greater. Further disadvantages exist in that the equipment is generally workshop tested before transport, so it requires the equipment to be dismantled and packed after testing. The dismantling of such cells for inspection purposes is specialized and demanding and requires special tools and equipment. It is also common to require the complete cell to be returned to the vendor for refurbishment.

In view of these disadvantages, an advancement in the field was realized with the advent of an electrolytic cell with a series of increasing diameter annular channels defined by concentric tubes. This design is described in U.S. Pat. No. 6,716,325 to Bentley entitled, "ELECTROLYTIC CELL FOR HYPOCHLORITE GENERATION, the entirety of which is incorporated herein by reference. However, the disadvantages and systematic limitations of this design have been discovered, which may limit the applicability of the electrolytic cell of the '325 Patent in certain contexts. For instance, a typical application of a hypochlorite generator employing electrolytic cells according to the '325 Patent was for use in a large-scale industrial context that included generators with high flow rates (e.g., 7 GPM or higher) and high current draw (e.g., 4000 A or greater) to produce large outputs of hypochlorite (e.g., 4 kg/hr or more) at a high concentration (e.g., 2,000 mg/L or more). However, other contexts have been contemplated in which cells according to the '325 Patent, may not be optimum. Accordingly, further improvements are needed to expand the applicability and advantages of such systems into other contexts.

SUMMARY

While the use of electrolytic cells with a series of increasing diameter annular channels as described in the '325 Patent above provides significant advantages over previously contemplated systems, the present disclosure relates to improvements that overcome certain limitations of such systems. Specifically, the present disclosure represents a further understanding of the operation of such systems that facilitate an expansion in the applicable contexts, sizes, and applications in which electrolytic generators of the kind described in the '325 Patent may be employed. With this further understanding of the operation of such systems, the present disclosure provides optimized configuration and/or operation of electrolytic generators generally to facilitate electrolytic cells for use in a variety of contexts including certain constrained systems. Moreover, it is presently discovered that improved characteristics of electrolytic cells may be realized that provide significant benefits for particular applications of the electrolytic cells.

For instance, one disadvantage of previous hypochlorite generators employing previously contemplated electrolytic cells has been that such hypochlorite generators were designed for large-scale applications such that the generators typically were of a large size, which limited the environments in which they can be installed. As described above, these large-scale applications typically included high flow rates with significant electrical current demands. Moreover, such applications typically emphasized total output or "capacity" as measured in a mass of hypochlorite generated per hour because the hypochlorite generators were often used in industrial settings with a continuous flow of chlorinated water through process systems as described above. That is, the overall amount of hypochlorite generated was prioritized over maximizing the concentration of hypochlorite for a given volume of water passed through the generator.

However, it is recognized herein that electrolytic cells or hypochlorite generators comprising a plurality of electrolytic cells that employ a series of increasing diameter annular channels defined by concentric tubes in smaller-scale applications with lower output and flow rate requirements may be desirable. Examples of such applications contemplated herein include volumetrically constrained systems. Volumetrically constrained systems refer to applications in which the volume of sodium hypochlorite enriched water that can be added for treatment is constrained (e.g., due to a limited final vessel to hold the hypochlorite enriched water or the like). One particular example of such a system relates to the treatment of water in ballast tanks in ships to prevent the growth and transportation of marine organisms. In this application, the volume of water that can be treated is constrained by the final volume of the ballast tank which will contain the hypochlorite enriched water. Moreover, as electrolytic cells in this context are operated on a vessel with highly constrained access to power, the efficient utilization of electrical power is of particular concern.

As such, the present disclosure includes approaches to maximize an output concentration of an electrolytic cell while reducing power consumption requirements for the cell. In relation to these parameters, it is presently recognized that the operation of an electrolytic cell may be generally described as:

$$\text{Current/Flow rate} = \text{Hypochlorite Concentration} \qquad \text{Equation 1}$$

In turn, for applications in which concentration of hypochlorite was to be maximized and power consumption reduced or minimized, an electrolytic cell having lower current and flow rates were considered than traditional approaches to the design of hypochlorite generators.

However, it was discovered that electrolytic cells operated at such reduced current and flow rates became highly susceptible to mineral scaling (e.g., the buildup of calcium and magnesium salts). Mineral scaling is problematic because it reduces efficiency by impeding the interaction between the electrodes and the saltwater, requiring periodic maintenance to descale. However, while prior approaches contemplated increased flow rates to prolong operation between descaling, increased flow rates resulted in decreased hypochlorite concentration achieved by the cell. As described above, this is particularly disadvantageous in volumetrically constrained systems or in other applications in which high concentrations of hypochlorite is desired (e.g., in use with ballast tanks, in breakpoint chlorination, or other contexts in which high concentration is desired). That is, it was found that reducing the physical and electrical scale of the electrolytic cell resulted in unexpected mineral scaling issues that reduced the effectiveness of such versions of the electrolytic cell when such electrolytic cells were attempted to be scaled to smaller sizes.

In turn, it is presently recognized that fluid flow characteristics in the electrolytic cell greatly affected the operation of the electrolytic cell. Specifically, it is presently recognized that low flow rates lead to premature mineral scaling, which results in extreme limitations on the duration an electrolytic cell could be operated without performing descaling flushes (e.g., using acidic, low pH, flushes). In turn, the present inventors further recognized that the somewhat turbulent flow of fluid through the electrolytic cell suppressed mineral scaling such that controlling flow conditions in the electrolytic cell in relation to the physical size of the cell could prolong the operation of the cell between descaling flushes. Specifically, it is currently recognized that an optimized Reynolds number of not less than about 30,000 and not greater than about 85,000 provided optimal operation of the electrolytic cell with a reduction in mineral scaling while allowing high concentrations of hypochlorite to be produced.

In turn, electrolytic cells of reduced physical scale were developed that employed lower electrical current consumption and lower flow rates, yet maintain a maximized hypochlorite concentration. Such cells were not previously contemplated or feasible using traditional cell designs, including those contemplated in the '325 Patent. A surface-to-surface spacing between an anode and cathode in the electrolytic cell was controlled to maintain optimized Reynolds number for a reduction in mineral scaling of the cell. The control of the surface-to-surface spacing allowed for size-scalable embodiments of the electrolytic generator that may be utilized at a lower electrical current draw and lower flow rates to maintain maximum hypochlorite concentration. In turn, cells of nearly any desired capacity can be produced. In this regard, "capacity" refers to the maximum rate of generation of hypochlorite in standard seawater (i.e., 3.5% salinity and 65° F.). For example, a 1 kg cell (i.e., 1 kg/hr capacity) may produce 1 kg of hypochlorite per hour using 1,000 A of electrical current and 0.5 $m^3$/hr of input saltwater in order to yield the desired 2,000 mg/L hypochlorite and a 2 kg cell may produce 2 kg of hypochlorite per hour using 2,000 A of electrical current and 1.0 $m^3$/hr of input saltwater.

Further still, it was unexpectedly discovered by the inventors that the electrical conversion efficiency of the cells increased with the smaller embodiments (i.e., the 1 kg cell and 2 kg cell designs). Specifically, prior instances of the electrolytic cell exhibited a conversion efficiency of between 4.5 and 6 kW per kg of sodium hypochlorite/sodium hypobromite per hour. In contrast, the reduced-scale embodiments with surface-to-surface spacing between the anode and cathode to optimize flow through the cell as presently described exhibit an improved conversion efficiency of 3.3 to 4.6 kW per kg per hour. Specifically, it is contemplated that the smaller spacing results in more power driving the electrochemical processing and less power being lost to secondary processes such as heating of the water, which provides an electrolytic cell that is significantly more efficient than prior art systems. That is to say, an electrolytic cell of the present invention provides a substantially increased hypochlorite output at a given power consumption level compared to prior art systems at the same power consumption level. By substituting electrolytic cells of the present invention for those of prior art systems, power consumption may be reduced by up to approximately 30%.

Further still, the present disclosure recognizes that the operational efficiency of scaled hypochlorite generators may be improved by favorable characteristics provided in relation to the electrical architecture used to power such generators. For instance, hypochlorite generators require the application of direct current (DC) electrical power to the cathode. Such DC power is often provided through a power supply that may include a rectifier for rectification of alternating current (AC) electrical power to the DC electrical power. It has been found that operational efficiencies may be provided in a hypochlorite generation system that employs a rectifier that provides lower currents and higher voltages to power the one or more electrolytic cells. Thus, the reduced scale electrolytic cells may be utilized in conjunction with such specifically sized rectifiers to provide operational efficiency advantages as noted above. In this regard, systems employing a plurality of electrolytic cells may be operated in series electrically with a higher output voltage and lower current from a rectifier powering the cells to achieve the same hypochlorite output of a larger cell with improved operational efficiency relative to the larger cell.

As described above, the improved efficiency of the present invention makes it particularly well-suited for certain applications such as the treatment of water in volumetrically constrained systems or breakpoint chlorination of saltwater with a high concentration of ammonia. Specifically, systems for breakpoint chlorination, particularly when treating a large body of water, typically require many electrolytic cells to produce the needed rate of highly concentrated hypochlorite. Accordingly, these systems consume a substantial amount of power. Up to four electrolytic cells in accordance with the present invention may be operated in series as a hypochlorite generator to produce hypochlorite in concentrations up to 8,000 mg/L at the improved conversion efficiencies achieved by the systems of the present disclosure. As an alternative, or in addition to a series arrangement, any number of cells may be operated in parallel as a hypochlorite generator to produce any required rate and volume of hypochlorite. It is recommended that cells of the same capacity be used when operated in series or parallel as a hypochlorite generator in order to enable a single rectifier to be used to power the entire group. However, different capacities may be used by deploying multiple rectifiers.

In view of the foregoing, the present invention is directed to an electrolytic cell that is relatively small in size, inhibits mineral scaling, and limits power consumption without sacrificing output concentration levels of hypochlorite. Such systems unexpectedly and beneficially increase the conversion efficiency of such cells. Electrolytic cells, as described herein, may be provided in series or parallel to comprise hypochlorite generators. In this regard, a hypochlorite generator may comprise a plurality of cells regardless of whether operated in series or parallel.

In a first aspect of the present invention, a hypochlorite generation system is provided, which includes an electrochemical cell, a flow controller, and a power supply. The electrochemical cell may also be referred to herein as an electrolytic cell. The electrochemical cell includes a plurality of annular electrolytic channels that are coaxially disposed about an axis of the electrolytic cell to be concentric relative to the axis. The electrolytic channels extend along a length of the electrolytic cell relative to the axis. Each annular electrolytic channel is fluidly connected to an adjacent concentrically disposed annular electrolytic channel. Each electrolytic channel includes a cathode surface and an anode surface defining a channel volume therebetween. A surface-to-surface spacing between adjacent cathode surfaces and anode surfaces may be not less than about 1.5 mm and not greater than about 8.0 mm, or more preferably, may be not less than about 3.2 mm and not greater than about 7.5 mm. A fluid flow path extends from an input of the electrolytic cell through the channel volume of each concentrically disposed annular electrolytic channel to an output of the electrolytic cell. The fluid flow path extends in a direction of increasing radial dimension relative to the annular electrolytic channels. The flow controller is operative to control a flow rate of saltwater through the electrolytic cell along the fluid flow path. The flow controller controls the flow rate of the saltwater through the electrochemical cell to be not less than about 0.35 $m^3$/hr and not greater than about 1.9 $m^3$/hr, and more preferably not less than about 0.75 $m^3$/hr and not greater than about 1.75 $m^3$/hr. The power supply is operative to provide an electrical current between the cathode members and the anode members of not less than about 370 A and not greater than about 3,700 A, and more preferably not less than about 1,500 A and not greater than about 3,500 A. The electrolytic cell is operative to output a sodium hypochlorite concentration in the saltwater at the outlet of not less than about 1,500 mg/L based on the flow rate and the electrical current.

In an embodiment, the hypochlorite generation system includes a finite supply volume of saltwater to be passed through the electrolytic cell. The finite supply volume of saltwater is limited by at least one of a supply volume restriction or a destination volume restriction. The outlet may be adapted to be in fluid communication with a destination tank to be filled by the saltwater comprising sodium hypochlorite in the saltwater from the output of the electrolytic cell. For example, the destination tank may be a ballast water tank of a ship.

In another embodiment, the input of the electrolytic cell is in fluid communication with a source of untreated water, and the output includes a treated water stream comprising water from the source and the sodium hypochlorite generated by the electrolytic cell. The source of untreated water may be a eutrophic or ammonia contaminated water source. The treated water stream may provide sodium hypochlorite at a concentration above a breakpoint chlorination level for the treated water.

In some embodiments, the power supply may provide a uniform anodic surface current density. For example, the uniform anodic surface current density may be not less than about 0.070 A/$cm^2$ and not greater than about 0.130 A/$cm^2$. In addition, the power supply may comprise a transformer and rectifier arrangement that may convert AC power (e.g., three-phase AC power) to DC power.

In another aspect of the present disclosure, a method of operation of an electrolytic cell is provided. The method includes controlling a flow rate of saltwater through an electrochemical cell to be not less than about 0.25 $m^3$/hr and not greater than about 1.5 $m^3$/hr. The electrolytic cell includes a plurality of annular electrolytic channels that are coaxially disposed about an axis of the electrolytic cell to be concentric relative to the axis. The electrolytic channels extend along a length of the electrochemical cell relative to the axis, and each annular electrolytic channel is fluidly connected to an adjacent concentrically disposed annular electrolytic channel. Each electrolytic channel comprises a cathode surface and an anode surface defining a channel volume therebetween. Each channel has a surface-to-surface spacing between the cathode surface and the anode surface not less than about 1.5 mm and not greater than about 6.5 mm. A fluid flow path extends from an input of the hypochlorite generate through the channel volume of each concentrically disposed annular electrolytic channel to an output of the electrolytic cell. The flow path extends in a direction of increasing radial dimension relative to the annular electrolytic channels. The method further includes applying an electrical current to the electrolytic cell between the cathode members and anode members of not less than about 200 A and not greater than about 2,000 A. The method also includes generating sodium hypochlorite in the electrolytic cell by an electrolysis reaction at the anode members in the presence of the saltwater and applied electrical current. The sodium hypochlorite is generated at a concentration of greater than about 1,800 mg/L based on the flow rate and the electrical current.

BRIEF DESCRIPTION OF THE DRAWINGS

The present invention will now be described, by way of example, with reference to the accompanying drawings, in which.

DETAILED DESCRIPTION

Figure 1:
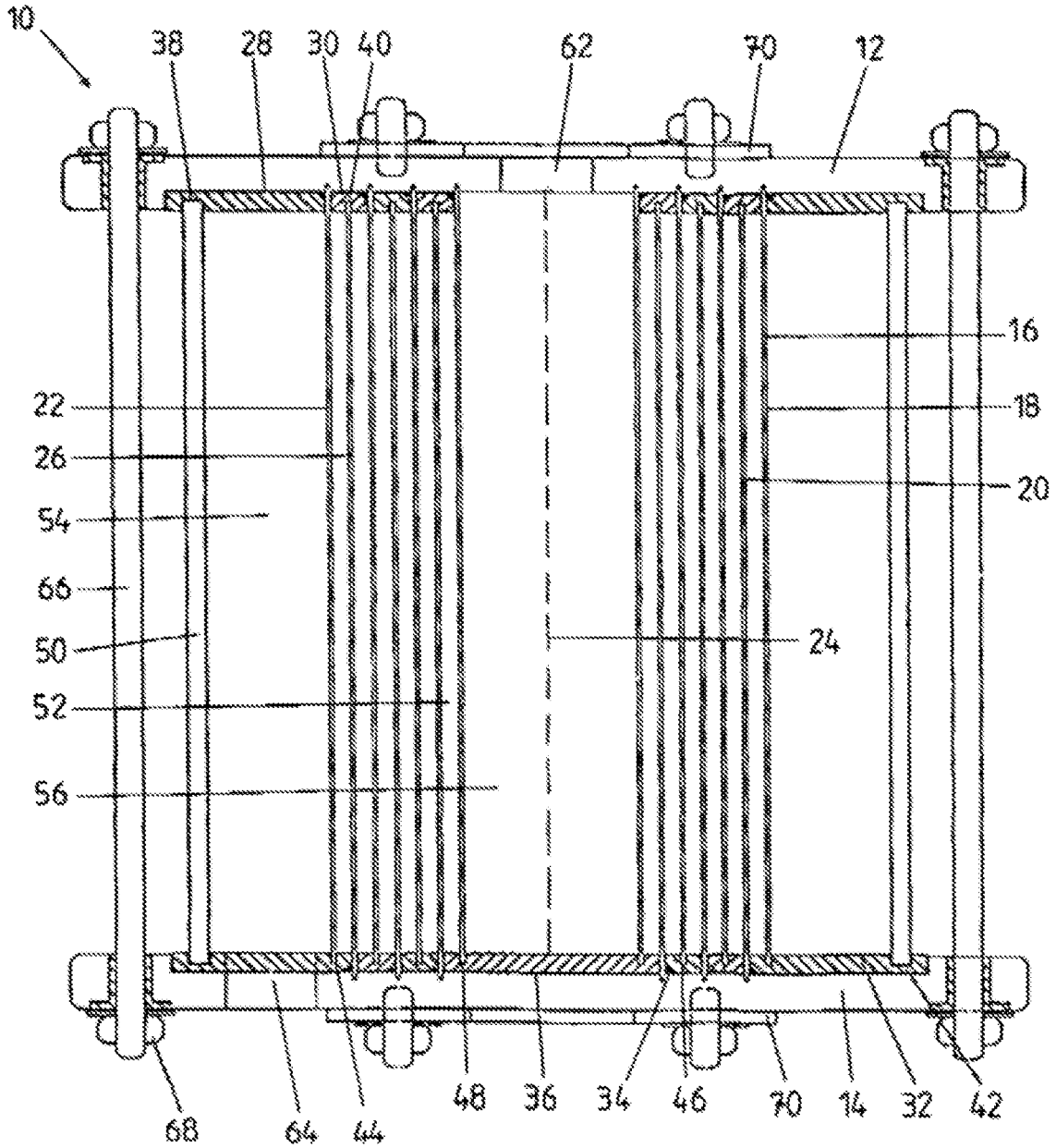
FIG. 1 is a side cross-sectional view of an electrolytic cell in accordance with the present invention.

While this disclosure is susceptible to various modifications and alternative forms, specific embodiments thereof have been shown by way of example in the drawings and are herein described in detail. It should be understood, however, that it is not intended to limit the disclosure to the particular form disclosed, but rather, the disclosure is to cover all modifications, equivalents, and alternatives falling within the scope as defined by the claims.

Referring to the figures, there is shown an electrolytic cell 10 for hypochlorite generation including a negative end flange member 12, a positive end flange member 14 and a plurality of electrodes 16. The electrodes 16 include at least one cathode 18 and at least one anode 20. The cathodes 18 comprise a first series of tube members 22 of successively increasing radius. Each cathode 18 is secured at a first end thereof to the negative end flange member 12 about a central longitudinal axis 24 of the electrolytic cell 10. The cathodes 18 are secured to the negative end flange member 12 by any suitable means, such as by welding.

The anodes 20 comprise a second series of tube members 26 of successively increasing radius. Each anode 20 is secured at a first end thereof to the positive end flange member 14 about the central longitudinal axis 24 of the electrolytic cell 10. The anodes 20 are secured to the positive end flange member 14 by any suitable means, such as by welding.

The anodes 20 preferably consist of titanium, plated on inner and outer surfaces with oxides of the platinum group of metals. The cathodes 18 are preferably unplated titanium.

Figure 2:
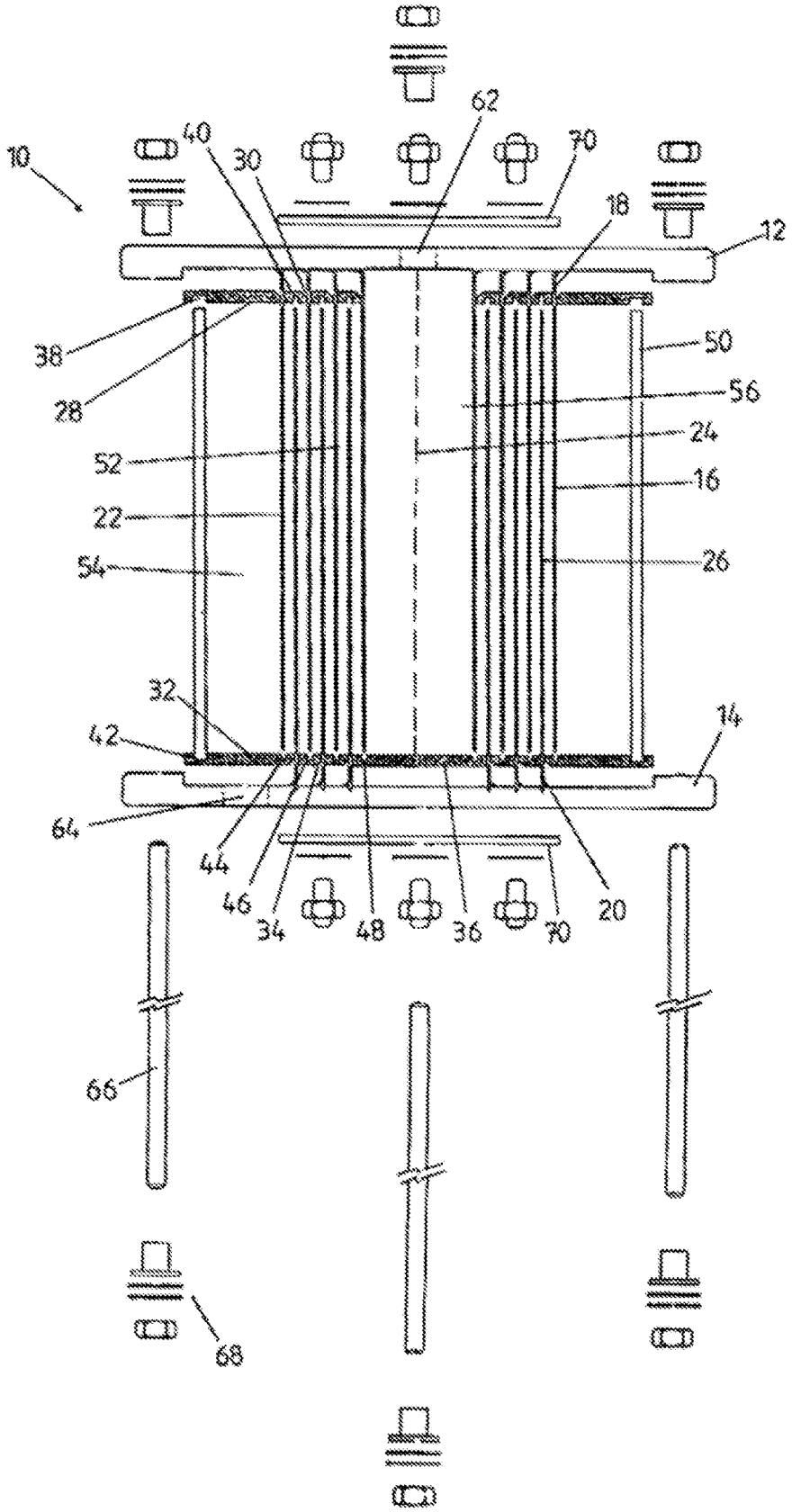
FIG. 2 is an exploded cross-sectional view of the electrolytic cell of FIG. 1.
Figure 3:
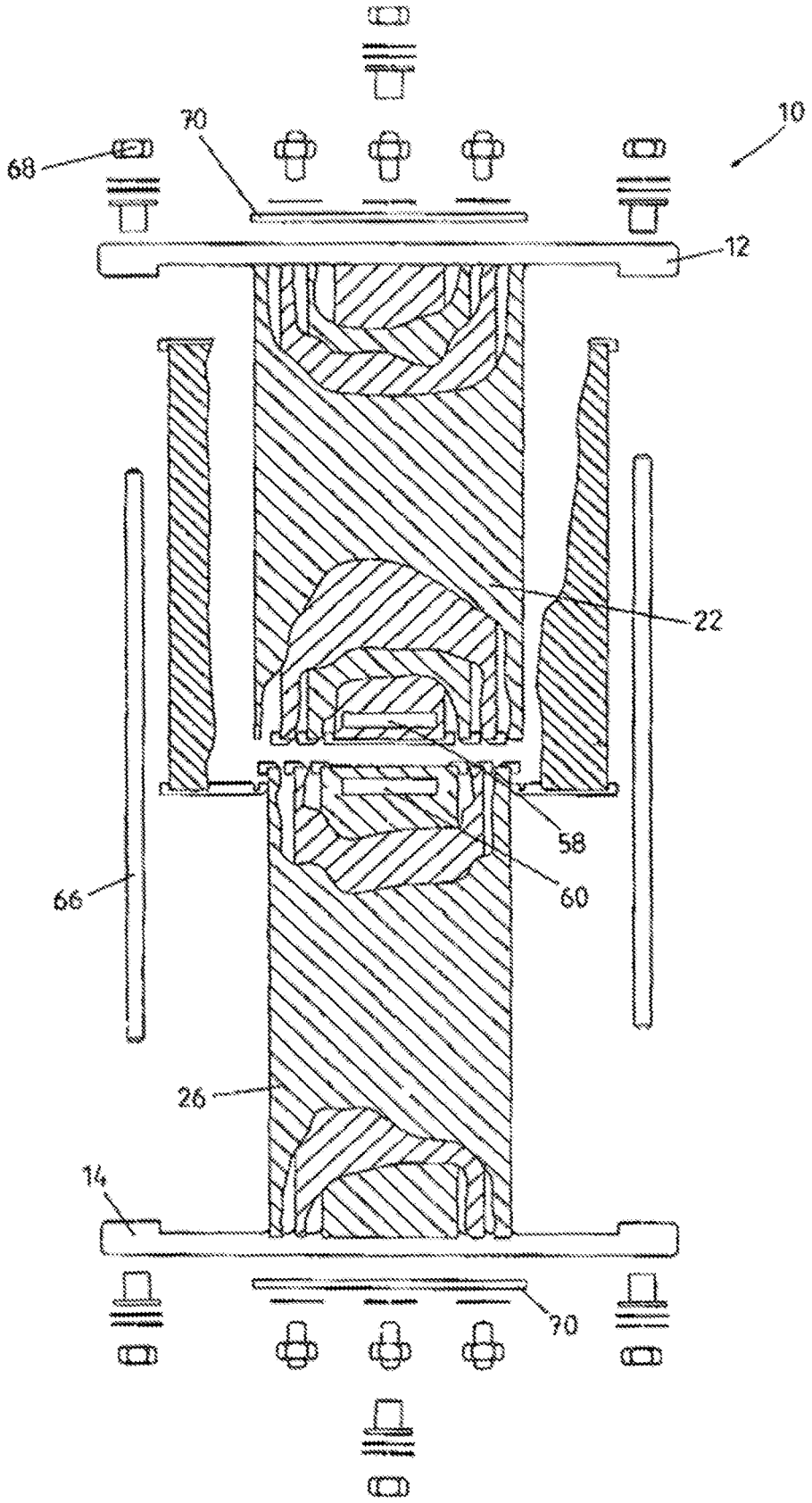
FIG. 3 is a side view of the electrolytic cell of FIG. 1 shown partially exploded and having portions of the anodes and cathodes cut away.
Figure 4:
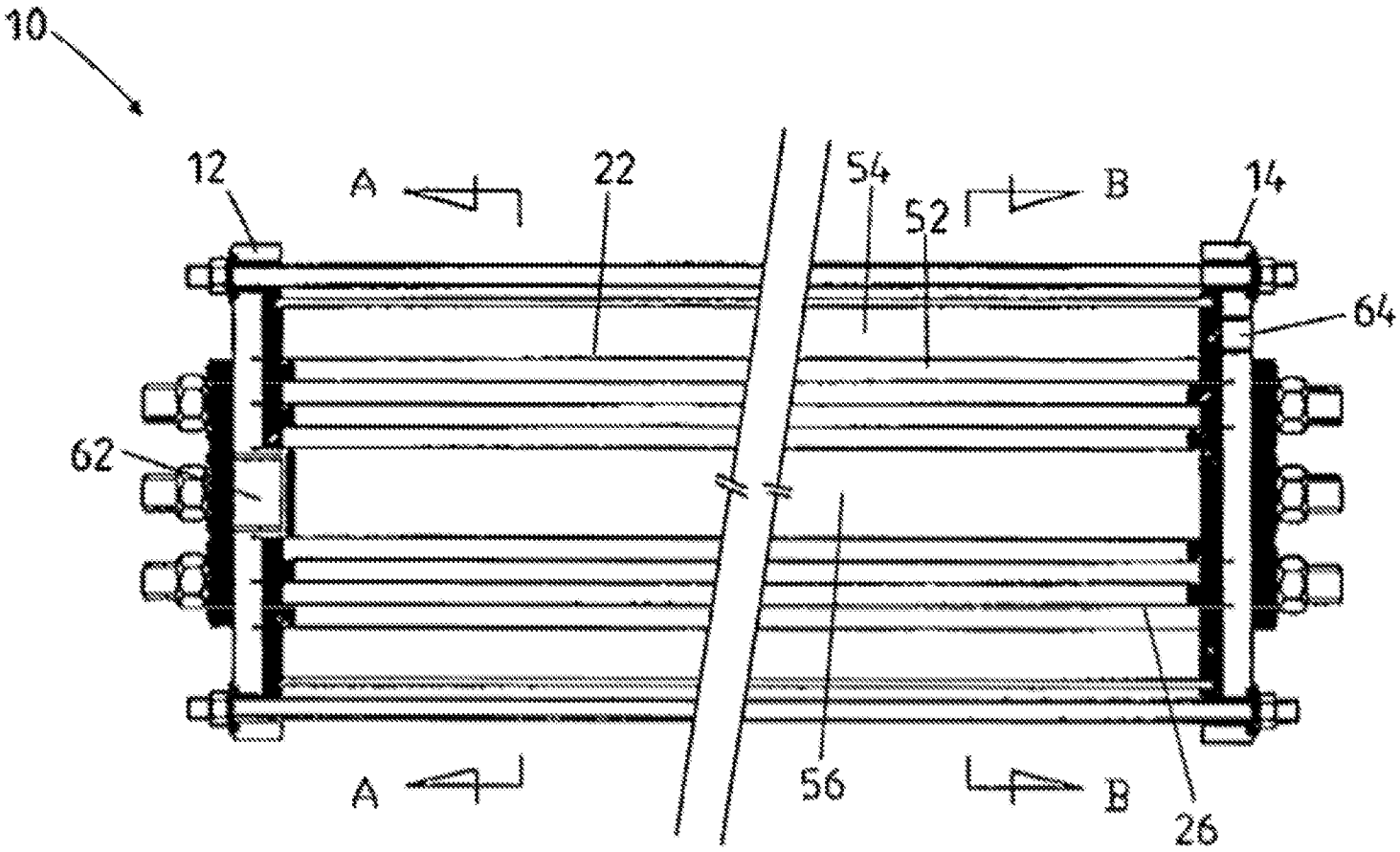
FIG. 4 is a side cross-sectional view of an alternate embodiment of an electrolytic cell in accordance with the present invention having fewer anodes and cathodes.
Figure 5:
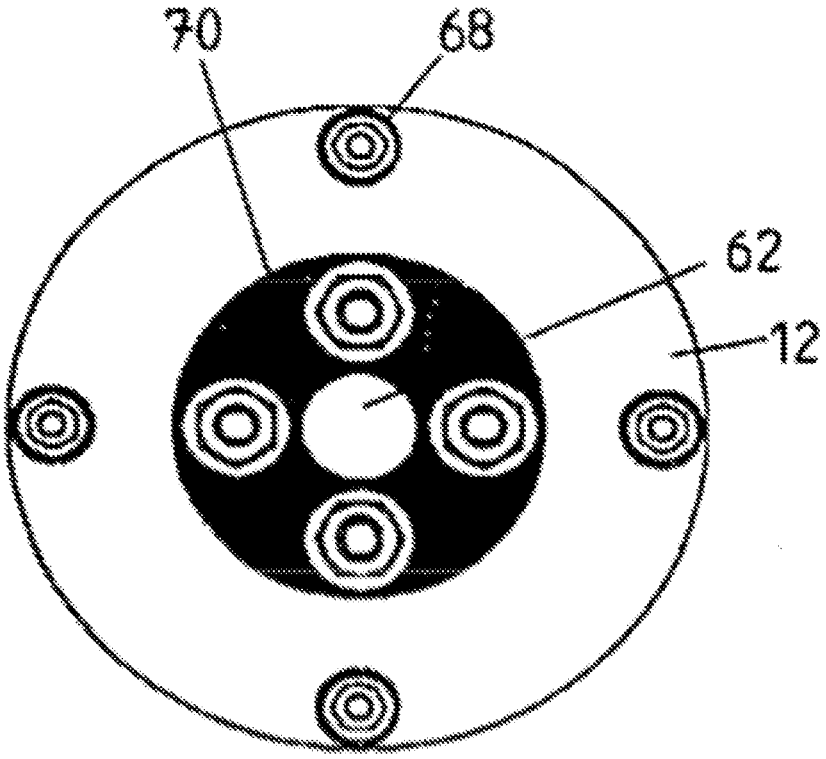
FIG. 5 is an end view of a first end of the electrolytic cell of FIG. 4.
Figure 6:
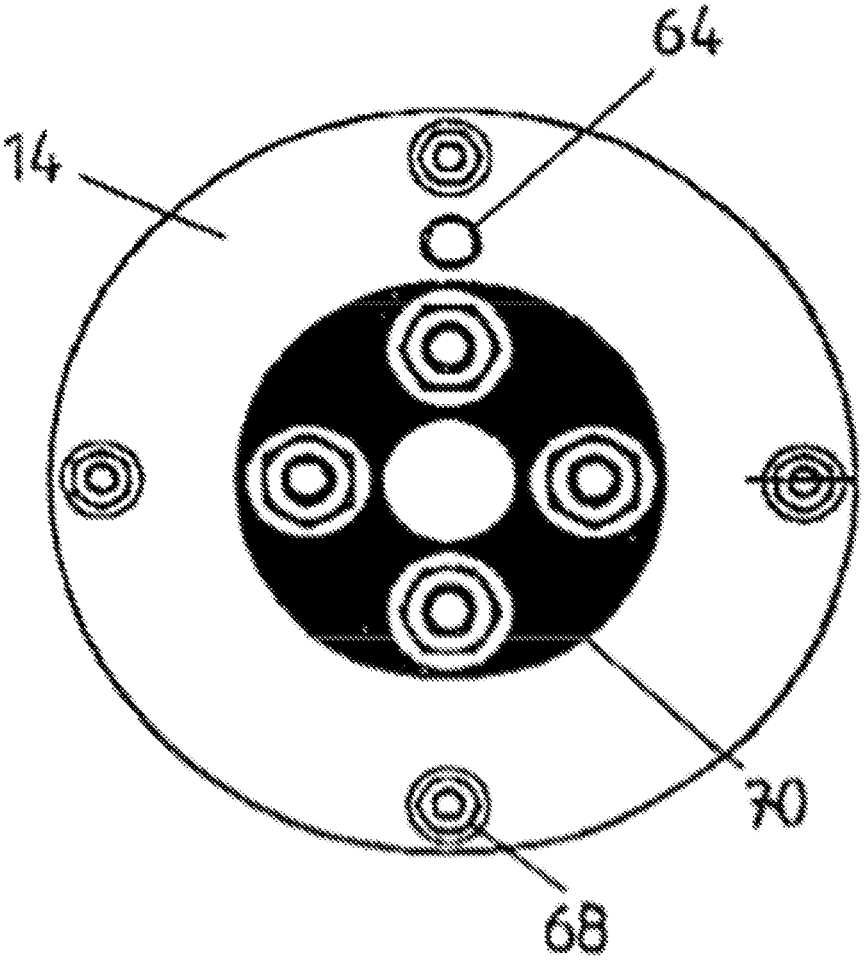
FIG. 6 is an end view of a second end of the electrolytic cell of FIG. 4.
Figure 7:
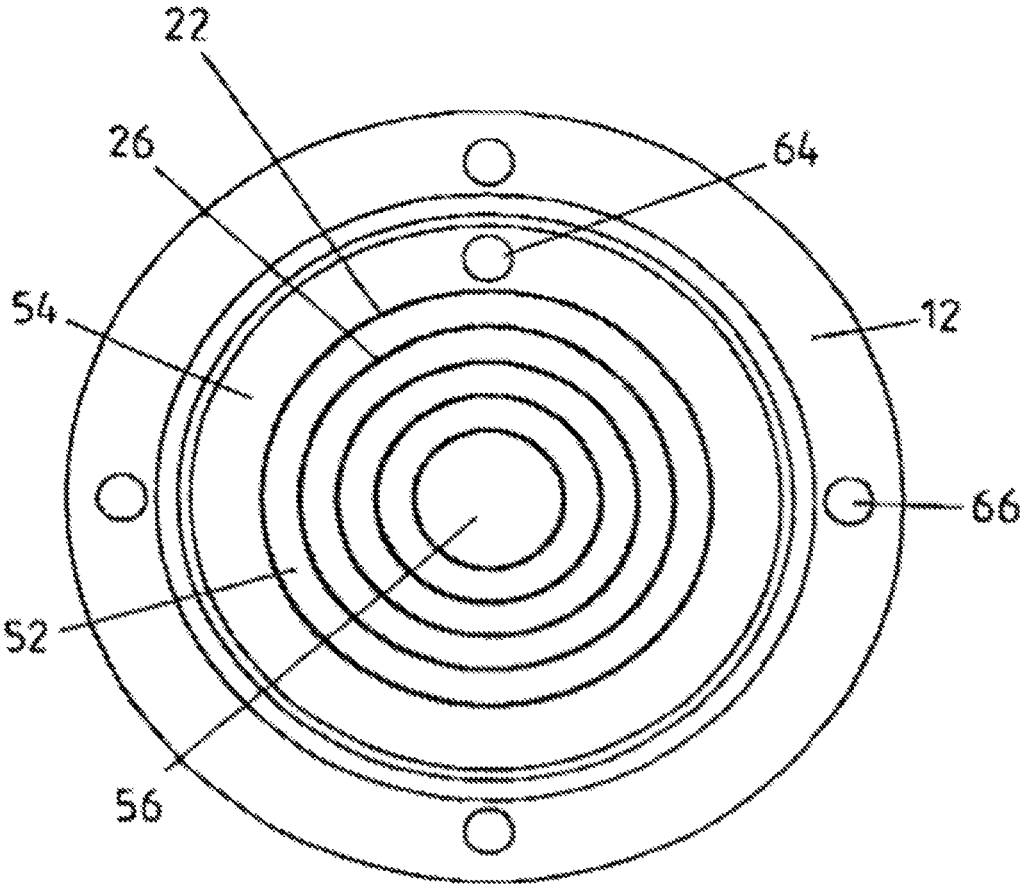
FIG. 7 is a cross-sectional view of the electrolytic cell of FIG. 5 cut through the line B-B.
Figure 8:
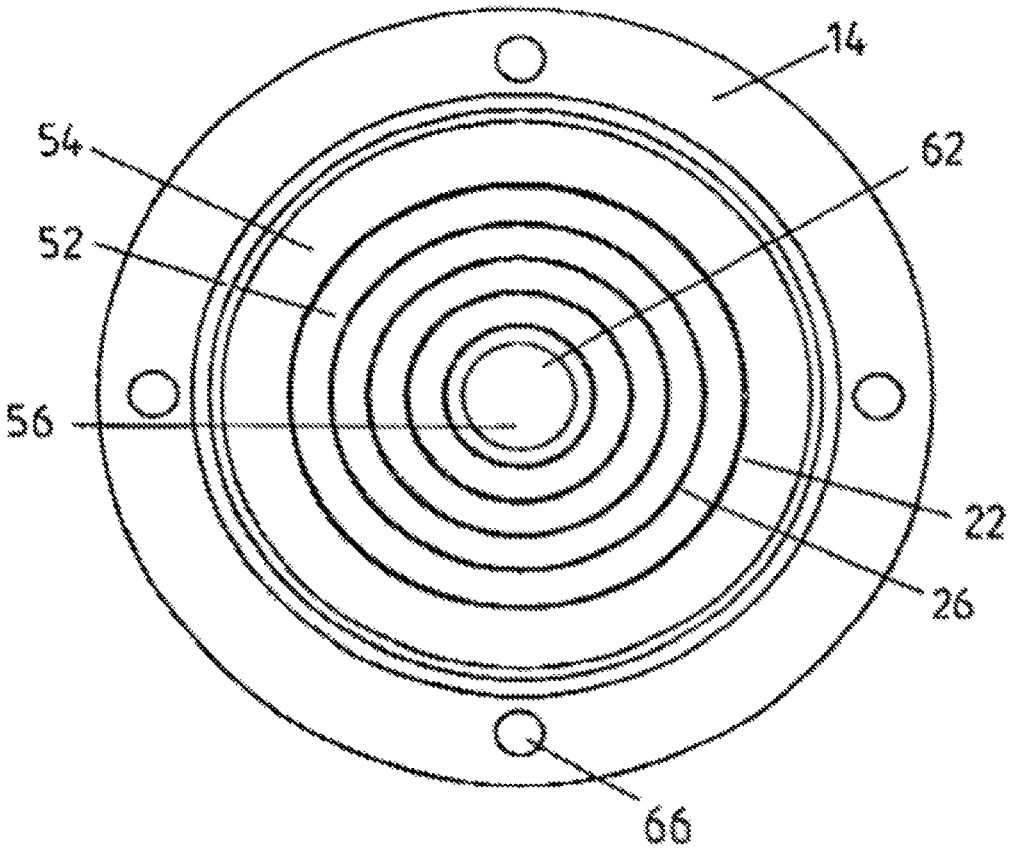
FIG. 8 is a cross-sectional view of the electrolytic cell of FIG. 5 cut through line A-A.
Figure 9:
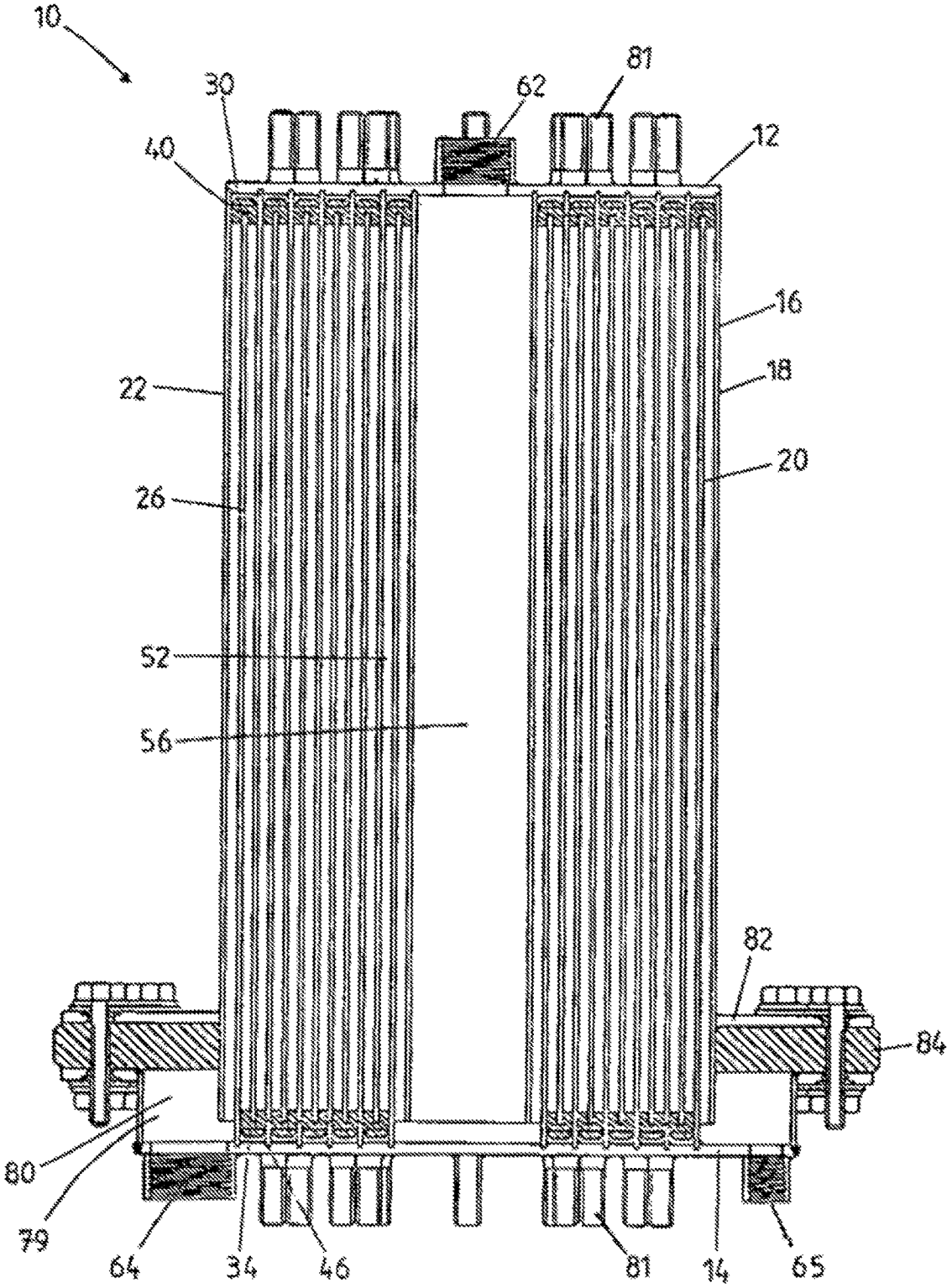
FIG. 9 is a side cross-sectional view of an alternate embodiment of an electrolytic cell in accordance with the present invention.
Figure 10:
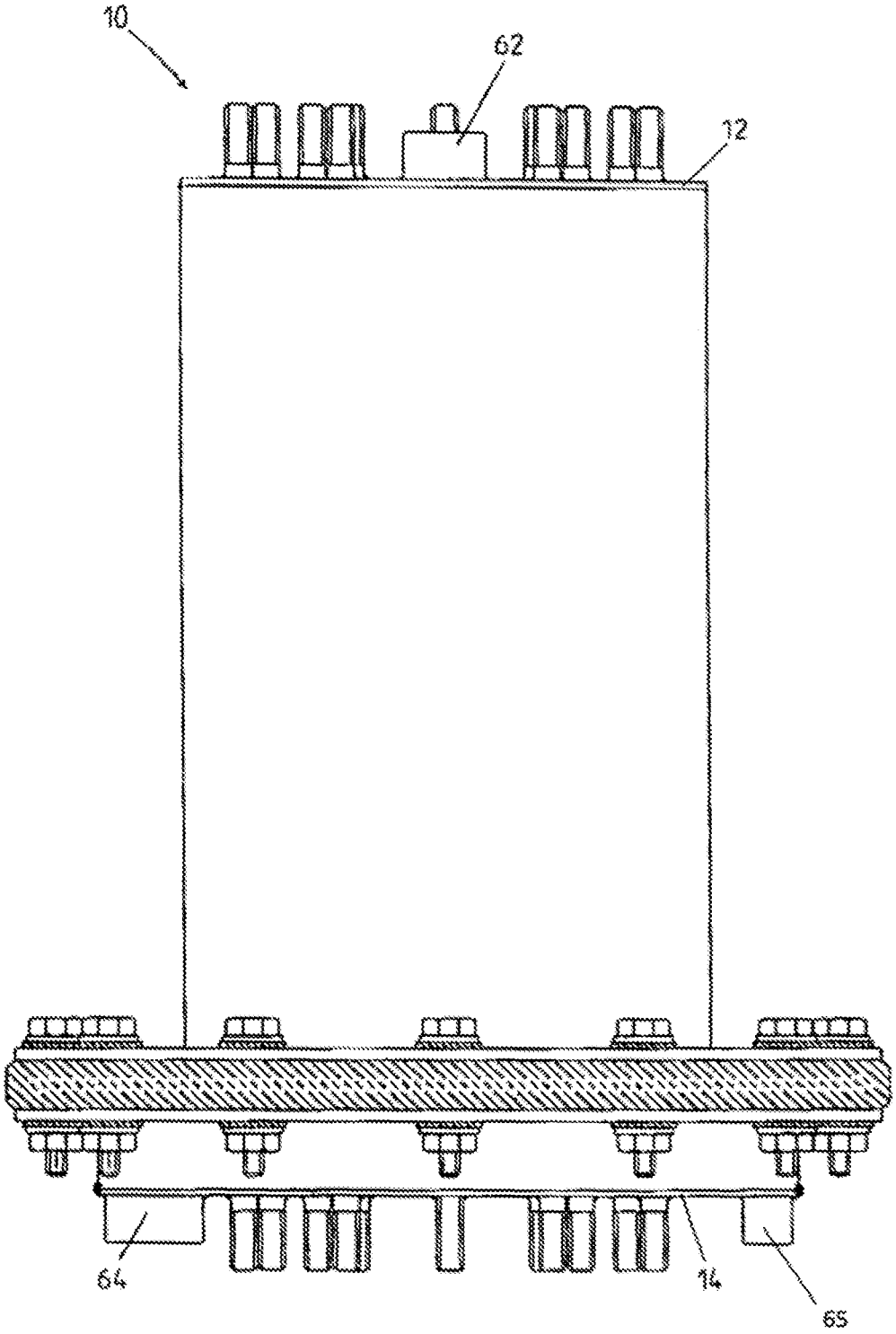
FIG. 10 is a side view of the electrolytic cell of FIG. 9.
Figure 11:
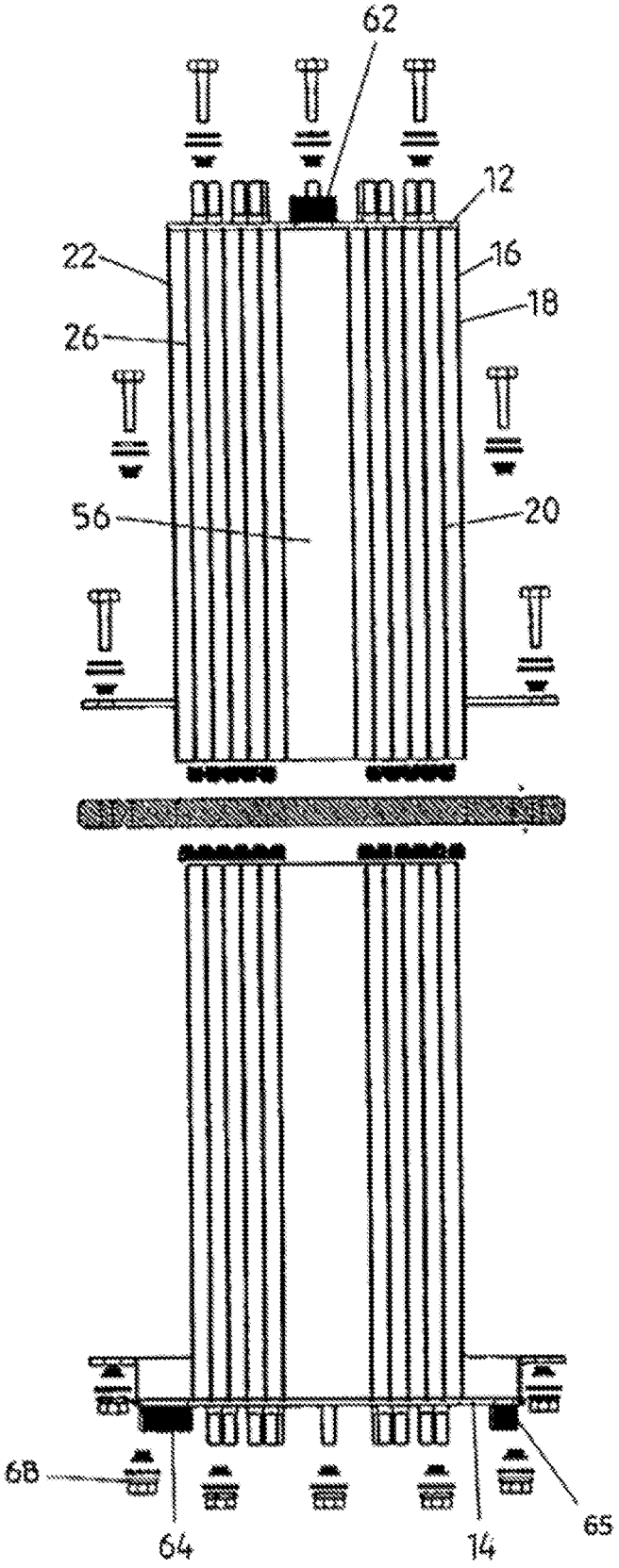
FIG. 11 is an exploded side cross-sectional view of the electrolytic cell of FIG. 9.
Figure 12:
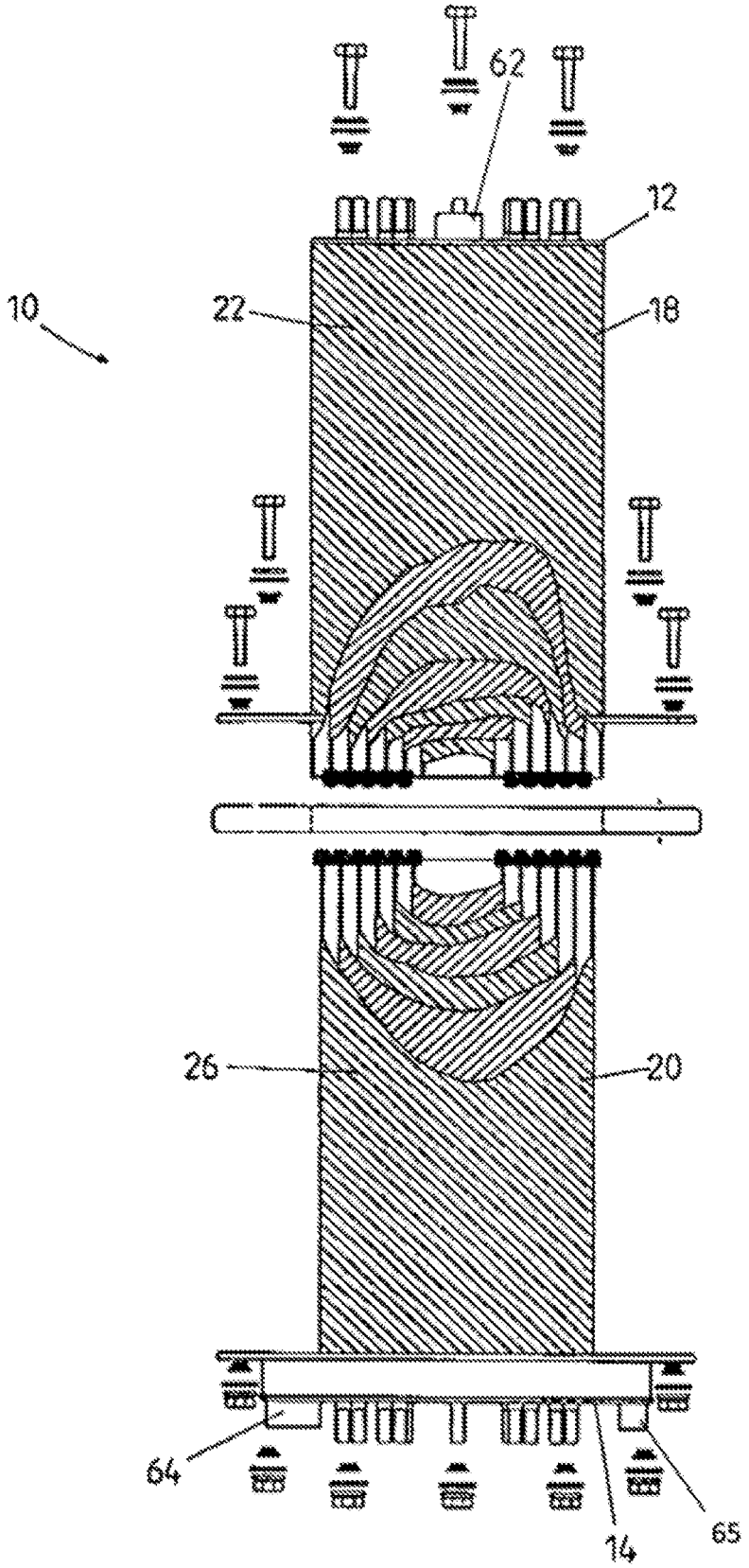
FIG. 12 is a side exploded view of the electrolytic cell of FIG. 9 with portions of the electrodes cut away.
Figure 13:
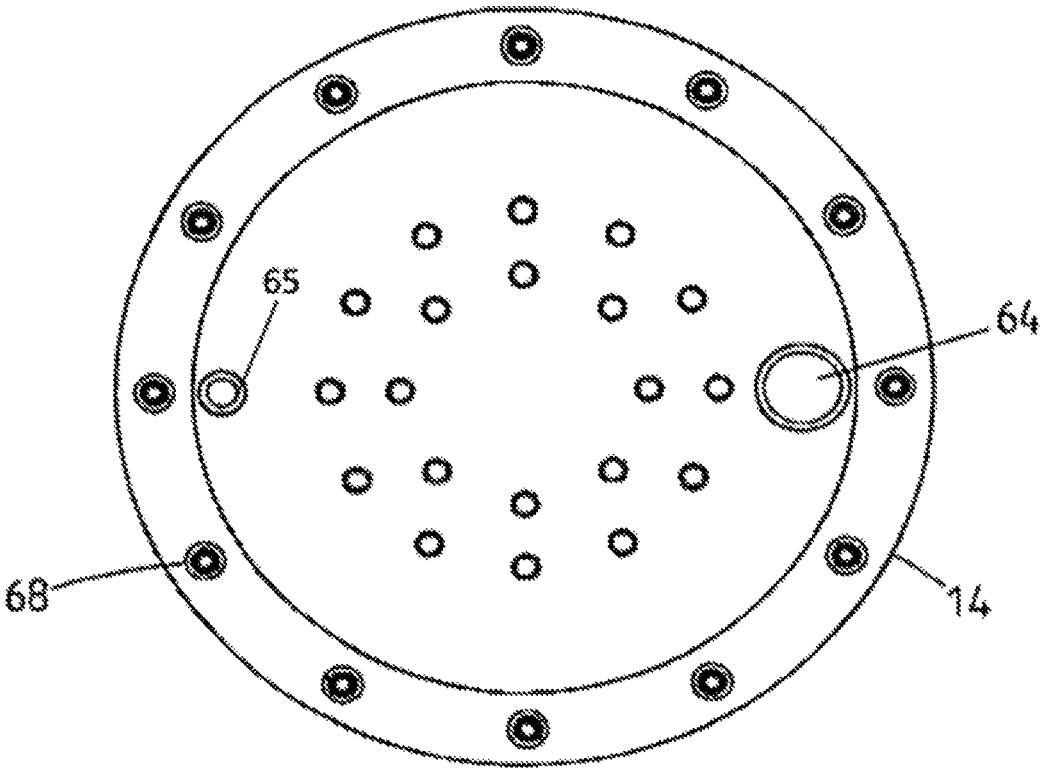
FIG. 13 is an end view of a first end of the electrolytic cell of FIG. 9.
Figure 14:
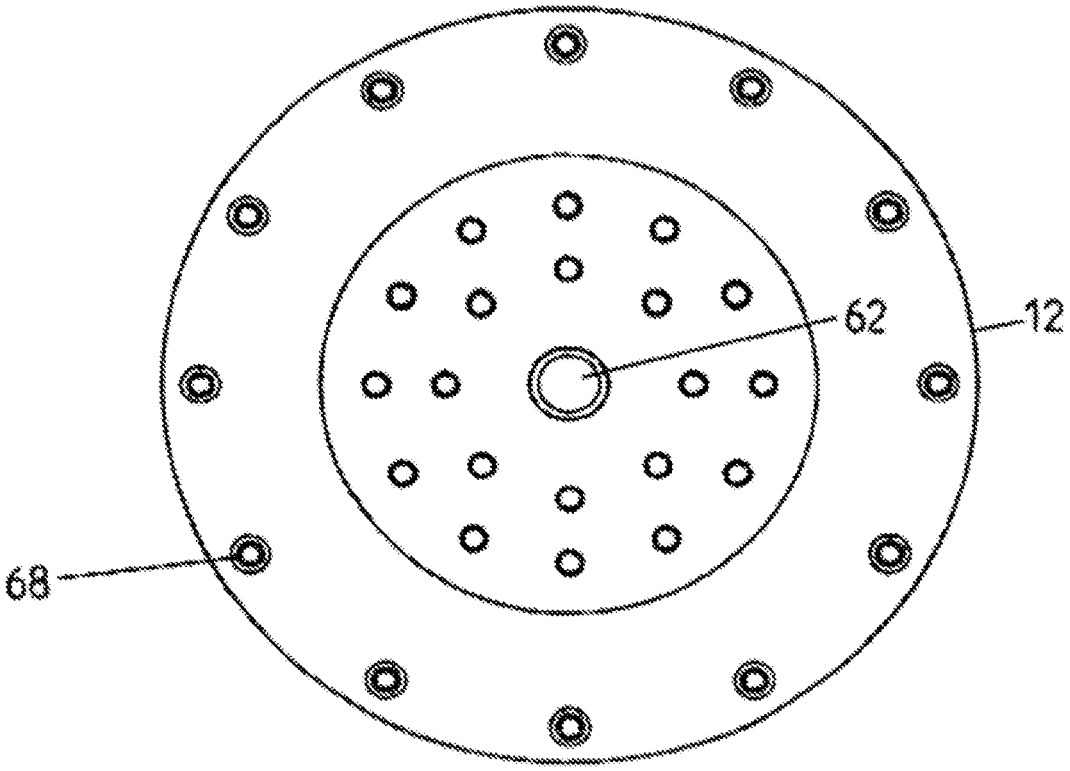
FIG. 14 is an end view of a second end of the electrolytic cell of FIG. 9.

In the embodiment shown in FIGS. 1 to 3, the electrolytic cell 10 includes four cathode tube members 22 and three anode tube members 26. The embodiment shown in FIGS. 4 to 8, shows an electrolytic cell 10, including three cathode tube members 22 and two anode tube members 26 and the embodiment in FIGS. 9 to 14 includes seven cathode tube members 22 and six anode tube members 26.

Referring to the embodiments shown in FIGS. 1 to 8, the electrolytic cell 10 includes a first outer spacer ring 28 and a plurality of first inner spacer rings 30. Also provided is a second outer spacer ring 32 and a plurality of second inner spacer rings 34. Further provided is a spacer disc 36. Each of the spacer rings 28, 30, 32 and 34 and the spacer disc 36 are made from an electrically insulating material, preferably PVC.

The first outer spacer ring 28 is arranged to be located around an outermost cathode tube member 22 adjacent to the negative end flange member 12. The first outer spacer ring 28 includes a circular groove 38 adjacent to its periphery. The first inner spacer rings 30 are arranged to be inserted between each cathode tube member 22 and an adjacent cathode tube member 22, adjacent to the negative end flange member 12. Each first inner spacer ring 30 includes a circular groove 40.

The second outer spacer ring 32 is arranged to be located around an outermost anode tube member 26 adjacent to the positive end flange member 14. The second outer spacer ring 32 includes a circular groove 42 adjacent its periphery. The second outer spacer ring 32 further includes a circular groove 44 adjacent to an inner edge. The second inner spacer rings 34 are arranged to be inserted between each anode tube member 26 and an adjacent anode tube member 26, adjacent to the positive end flange member 14. Each second inner spacer ring 34 includes a circular groove 46. The spacer disc 36 is arranged to be inserted within an innermost anode tube member 26 adjacent to the positive end flange member 14. The spacer disc 36 includes a groove 48 adjacent to its periphery.

The anode tube members 26 and cathode tube members 22 are arranged such that each anode tube member 26 may be received in the annular space between a pair of adjacent cathode tube members, as shown in FIG. 2. A second end of each anode tube member 26 is received within the groove 40 in a corresponding first spacer ring 30.

A second end of the outermost cathode tube member 22 is received within the groove 44 in the second outer spacer ring 32. A second end of the innermost cathode tube member 22 is received within the groove 48 in the spacer disc 36. Second ends of each inner cathode tube member 22 are received within the groove 46 in a corresponding second spacer ring 34.

The spacer rings 28, 30, 32, 34, and disc 36 are configured to maintain a desired spacing between adjacent cathode and anode surfaces. In this regard, the surface-to-surface spacing may be controlled to produce cells in a scalable fashion while maintaining high concentration and reduced mineral scaling. This spacing may be determined based on a variety of factors. First, the inventors of the present invention have determined that it is preferable to produce water with a single-pass hypochlorite concentration of not less than about 1,800 mg/L, preferably about 2,000 mg/L, to optimize the efficiency of production, while also recognizing that a certain degree of turbulence is preferable to reduce mineral scaling. In this regard, the 8.6 mm spacing of a 4 kg cell was found to be unsatisfactory for a smaller 2 kg cell as an increased rate of mineral scaling was observed.

Working from an identified range of acceptable Reynolds numbers to resist mineral scaling, it was discovered that a spacing of approximately 4.3 mm was preferable in a 2 kg cell given the desired flow rate of 1 $m^3$/hr based on targeted concentration and current. Further, a 1 kg cell could be configured with a spacing of 2.15 mm to maintain a sufficient Reynolds number and the desired flow rate of 0.5 $m^3$/hr with an output concentration of 2,000 mg/L and 1000 A current. However, such small spacing is difficult and costly to achieve in manufacturing and also increases susceptibility to flow obstruction by foreign objects or debris. In this regard, it is advantageous to reduce the spacing between adjacent cathodes and anodes as much as possible, although there are practical limitations associated with reducing the spacing too much that must be considered. Accordingly, preferable embodiments range from a 1.5 kg to a 3.5 kg cell, which corresponds to spacings between adjacent cathodes and anodes, such as cathode 18 and anode 20, of no less than approximately 3.2 mm and no greater than approximately 7.5 mm, respectively. In this regard, cells with capacities below 1.5 kg/hr are considered within the scope of this invention but may have limited uses, such as when input water is well-filtered to ensure the channels are not obstructed with debris and when increased manufacturing costs are tolerable. For example, it is contemplated that a 0.5 kg or smaller cell may be constructed, which would correspond to a cathode to anode spacing of approximately 1.1 mm or less.

The electrolytic cell 10 is further provided with a tubular casing member 50. A first end of the tubular casing member 50 is arranged to be received within the groove 38 in the first outer spacer ring 28. A second end of the tubular casing member 50 is arranged to be received within the groove 42 in the second outer spacer ring 32.

The arrangement of the electrodes 16 defines a plurality of annular channels 52 defined by the space between each adjacent cathode tube member 22 and anode tube member 26. Also included is an outer annular channel 54 defined by the space between the outermost cathode tube member 22 and the tubular casing member 50. An inner channel 56 is defined by the space within the innermost cathode member 22. Each cathode tube member 22 is provided with a first opening 58 adjacent the second end thereof, and each anode tube member 26 is provided with a second opening 60 adjacent a second end thereof, as can be seen in FIG. 3.

The negative end flange member 12 has a first aperture 62 in fluid communication with the inner channel 56. The positive end flange member 14 has a second aperture 64 in fluid communication with the outer annular channel 54.

The electrolytic cell 10 further includes a plurality of securing rods 66. The securing rods 66 are inserted through holes in the negative end flange member 12 and corresponding holes in the positive end flange member 14 and secured by securing nuts 68.

A shorting ring 70 is secured to each of the negative and positive end plates 12 and 14 through which voltage is supplied. The shorting rings are preferably made of copper or aluminum and are used for enhanced current distribution. The end flanges 12 and 14 are preferably made of Hastelloy C or titanium.

Further, the electrolytic cell 10 may include isolating valves or true unions (not shown) adjacent first and second apertures 62 and 64 so that the cell may be isolated for maintenance.

FIGS. 9 to 14 show an alternate embodiment of an electrolytic cell 10 in accordance with the present invention where like numerals denote like parts. The electrolytic cell 10 includes a positive end flange member 14 having an annular recess 79 around the outermost anode tube member 26 in fluid communication with the opening 64. A flange member 82 with a sealing ring 84 is provided about the outermost cathode tube member 22 such that when the electrolytic cell is assembled, the flange member 82 and sealing ring 84 cover the annular recess 79 in the positive end flange member 14 to define an annular cavity 80.

In use, the second end of the outermost cathode tube member 22 is not received within a second outer spacer ring but is received within the annular cavity 80 such that the outermost channel 52 is in fluid communication with the annular cavity 80.

The water flowing along the outermost annular channel 52, therefore, flows out of the open end of the outermost cathode tube member 22 and out of the second aperture 64 and a third aperture 65 via the annular cavity 80. In this embodiment, the outer casing 50 is no longer required.

A plurality of threaded studs 81 are secured to the outer face of the negative and positive end flange members 12 and 14 by any suitable method, such as welding. The threaded studs protrude through positive and negative copper or aluminum bus bars (not shown) and are secured by threaded nuts to evenly distribute the electrical current into the positive and negative end flange members 12 and 14.

In use, the electrolytic cell 10 is assembled as described above, and the negative and positive end flange members 12 and 14 are supplied with a suitable potential and distribute the applied current more evenly to each cylindrical tube.

Saltwater is supplied to the cell through first aperture 62 and flows through the inner channel 56 generally toward the positive end flange member 14. The saltwater flow passes through the first opening 58 in the innermost cathode tube member 22 and then flows generally toward the negative end flange member 12 along the innermost annular channel 52. The saltwater then continues through successive annular channels 52 via openings 58 and 60 until it emerges into outer annular channel 54 and subsequently passes out of the cell through opening 64. Electrolysis occurring throughout the flow results in a solution containing sodium hypochlorite emerging from the cell 10 at openings 64 and 65.

Due to the arrangement of the electrodes within each other, an electrolytic cell 10 results, which is physically small in size while retaining a long residence time of the saltwater solution between anodes and cathodes. The increase in the cross-sectional area of the annular channels 52 also results in a lower electrolyte velocity towards the outer channels, which has the advantage of increasing the residence time of the solution in proximity to the electrodes as the solution becomes more depleted as it travels through the cell 10.

The arrangement of having the water flow in alternating directions along the cell between shorter parallel electrodes connected from opposite ends causes an equal and opposite voltage drop, resulting in a more uniform current density over all the surfaces of the electrodes than would be the case where a single pair of electrodes connected from the same end were used. The inventors have devised that an optimum current density of an electrolytic cell is −0.112 A/$cm^2$. In this regard, a 2 kg cell is preferably operated at 2,000 A, while a 1 kg cell is preferably operated at 1000 A. Feeding the positive and negative polarities from opposed physical ends results in an even current density over all the anode and cathode surfaces due to the opposed voltage gradients. This results in an even wear of the mixed metal oxides of platinum coating the anodes.

The construction also results in a cell that can be assembled and disassembled without the need for specialized tools. Further, if renewal of the coating of mixed metal oxides of the platinum group of metals is required, the positive end flange which includes the anode tube members can be removed and sent for replating, without the need for sending the whole electrolytic cell.

Figure 15:
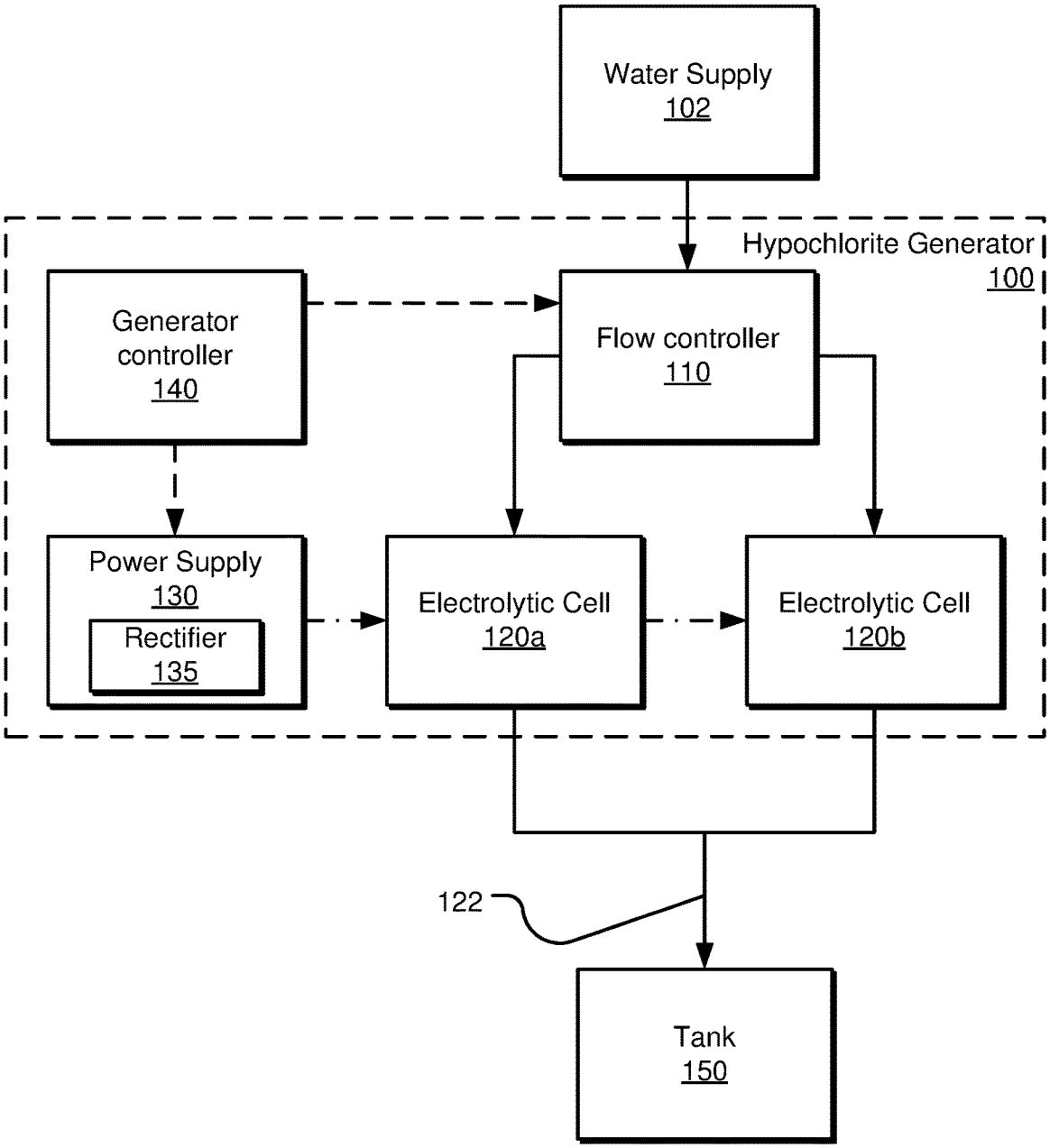
FIG. 15 is a schematic view of a hypochlorite generator.

With further reference to FIG. 15, an example of a hypochlorite generator 100 is shown. In FIG. 15, solid lines represent a flow of water through the generator 100, dashed lines represent control signals, and dash-dot lines represent operational electrical power.

The generator 100 may be in fluid communication with a water supply 102 for the supply of seawater or salinized water to the generator 100. In addition, the generator 100 may supply water containing hypochlorite via a discharge 122 to a tank 150. For example, the tank 150 may be a ballast tank of a ship or other tank 150 of limited or constrained volume. In this regard, the generator 100 may operate in a volumetrically constrained system in which a highly concentrated hypochlorite solution is supplied to the tank 150. Accordingly, the generator 100 may be designed to maximize the hypochlorite concentration in the discharge 122.

The generator 100 includes a generator controller 140 that, as described in greater detail below, may be executed by a processing system for control of the operation of the generator 100. The controller 140 may be in operative communication with a flow controller 110. The flow controller 110 may manage the flow of water from the water supply 102 to at least a first electrolytic cell 120*a* and a second electrolytic cell 120*b*. Each electrolytic cell 120 may be provided according to any of the foregoing discussion. The flow controller 110 may include various components used to manage flow to the electrolytic cells 120. For example, the flow controller 110 may include valves, pumps, manifolds, tanks, or other equipment used to manage the flow of water to the electrolytic cells 120. Specifically, the flow rate to the electrolytic cells 120 may be controlled to provide flow rates according to any of the examples provided above.

In addition, the controller 140 may be operative to control the operation of a power supply 130 that supplies electrical power to the electrolytic cells 120. The power supply 130 may include a rectifier 135 for the conversion of alternating current input to direct current power output. As briefly described above, it is presently recognized that the operation of the rectifier 135 may be advantageous to provide relatively low currents and high voltages. For example, as shown in FIG. 15, the electrolytic cell 120*a* and electrolytic cell 120*b* may receive electrical power from the power supply 130 in a series arrangement rather than in parallel. In turn, relatively higher voltage and lower current may be supplied to the cells 120. For instance, and as will be described in greater detail below, it has been found that a heat rejection factor for the reciter 135 scales with current rather than voltage, which provides operational efficiencies of the generator 100.

In one particular context, a previously contemplated hypochlorite generator may operate with a 4,000 A current applied as direct current to the electrolytic cell. Such a generator may employ a single cell that produces 4 kg/hr of hypochlorite at a high concentration (e.g., 2,000 mg/L or greater) using a flow rate of 7 GPM or higher. In empirical testing, such a generator may require greater than 8 KW (e.g., between 8 and 9.5 KW based on operational voltages between 12V and 36V) to operate. In contrast, a generator 100, as shown in FIG. 15 may operate such that the power supply 130 provides electrical power in series to the electrolytic cell 120*a* and electrolytic cell 120*b* at 36 V and 2,000 A. The collective flow rate of the cells may match the 7 GPM of the traditional generator to produce hypochlorite at a rate of 4 kg/hr at a concentration of greater than 2,000 mg/L. However, the advantageous arrangement of the cells 120 in series may draw only between 4.5 KW and 5 KW. Thus, for the same concentration and overall output of hypochlorite, the arrangement as shown in FIG. 15 demonstrates an efficiency improvement of between 52% and 56% compared to prior approaches utilizing a single 4,000 A cell. In this regard, the reduced scale cells 120 that are capable of being provided according to the disclosure provided herein may facilitate substantial and surprising increases in efficiency.

In turn, the operational efficiency of the generator 100 may be improved as compared to traditional approaches. Moreover, the heat rejection factor for the power supply 130 may be reduced as compared to traditional approaches. That is, the operation of the rectifier 135 may generate waste heat during operation. Usually, such equipment must be cooled (e.g., using cooling systems or the like). Particularly in energy-constrained systems (e.g., ships in which onboard fuel must be consumed to both power the power supply 130 and manage any waste heat), such operational efficiencies and reduction in heat rejection factor may provide advantages in both reduced capital expenditure (e.g., by allowing smaller or more cost-efficient power, cooling, or other systems to be installed) as well as reduced operating expenditures through more efficient operation.

Modifications and variations as would be apparent to a skilled addressee are deemed to be within the scope of the present invention. For example, the number of electrodes contained within the electrolytic cell may be varied, or the polarities of the end flange members may be reversed.

Figure 16:
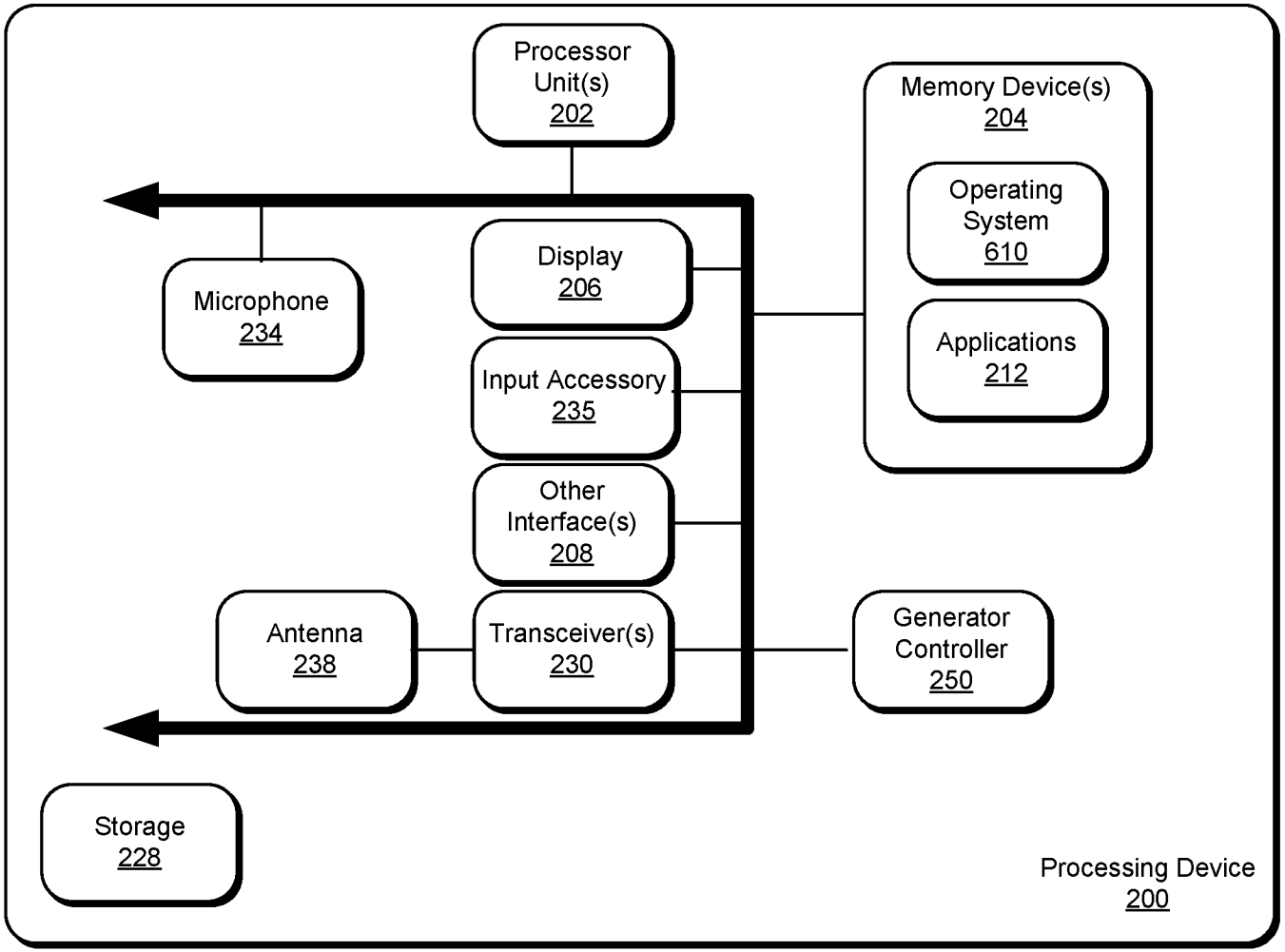
FIG. 16 is a schematic view of a processing system capable of implementing a number of aspects of the present disclosure.

FIG. 16 illustrates an example schematic of a processing system 200 suitable for implementing aspects of the disclosed technology including a display controller 214 as described above. The processing system 200 includes one or more processor unit(s) 202, memory 204, a display 206, and other interfaces 208 (e.g., buttons). The memory 204 generally includes both volatile memory (e.g., RAM) and non-volatile memory (e.g., flash memory). An operating system 210, such as the Microsoft Windows® operating system, the Apple macOS operating system, or the Linux operating system, resides in the memory 204 and is executed by the processor unit(s) 202, although it should be understood that other operating systems may be employed.

One or more applications 212 are loaded in the memory 204 and executed on the operating system 210 by the processor unit(s) 202. Applications 212 may receive input from various input local devices such as a microphone 234, input accessory 235 (e.g., keypad, mouse, stylus, touchpad, joystick, instrument mounted input, or the like). Additionally, the applications 212 may receive input from one or more remote devices such as remotely-located smart devices by communicating with such devices over a wired or wireless network using more communication transceivers 230 and an antenna 238 to provide network connectivity (e.g., a mobile phone network, Wi-Fi®, Bluetooth®). The processing system 200 may also include various other components, such as a positioning system (e.g., a global positioning satellite transceiver), one or more accelerometers, one or more cameras, an audio interface (e.g., the microphone 234, an audio amplifier and speaker and/or audio jack), and storage devices 228. Other configurations may also be employed.

The processing system 200 further includes a power supply 216, which is powered by one or more batteries or other power sources and which provides power to other components of the processing system 200. The power supply 216 may also be connected to an external power source (not shown) that overrides or recharges the built-in batteries or other power sources.

In an example implementation, a generator controller 250 may be provided that may include hardware and/or software embodied by instructions stored in the memory 204 and/or the storage devices 228 and processed by the processor unit(s) 202. The memory 204 may be the memory of a host device or of an accessory that couples to the host.

The processing system 200 may include a variety of tangible processor-readable storage media and intangible processor-readable communication signals. Tangible processor-readable storage can be embodied by any available media that can be accessed by the processing system 200 and includes both volatile and nonvolatile storage media, removable and non-removable storage media. Tangible processor-readable storage media excludes intangible communications signals and includes volatile and nonvolatile, removable and non-removable storage media implemented in any method or technology for storage of information such as processor-readable instructions, data structures, program modules or other data. Tangible processor-readable storage media includes, but is not limited to, RAM, ROM, EEPROM, flash memory or other memory technology, CDROM, digital versatile disks (DVD) or other optical disk storage, magnetic cassettes, magnetic tape, magnetic disk storage or other magnetic storage devices, or any other tangible medium which can be used to store the desired information and which can be accessed by the processing system 200. In contrast to tangible processor-readable storage media, intangible processor-readable communication signals may embody processor-readable instructions, data structures, program modules or other data resident in a modulated data signal, such as a carrier wave or other signal transport mechanism. The term "modulated data signal" means an intangible communications signal that has one or more of its characteristics set or changed in such a manner as to encode information in the signal. By way of example, and not limitation, intangible communication signals include signals traveling through wired media such as a wired network or direct-wired connection, and wireless media such as acoustic, RF, infrared, and other wireless media.

Some implementations may comprise an article of manufacture. An article of manufacture may comprise a tangible storage medium to store logic. Examples of a storage medium may include one or more types of processor-readable storage media capable of storing electronic data, including volatile memory or non-volatile memory, removable or non-removable memory, erasable or non-erasable memory, writeable or re-writeable memory, and so forth. Examples of the logic may include various software elements, such as software components, programs, applications, computer programs, application programs, system programs, machine programs, operating system software, middleware, firmware, software modules, routines, subroutines, operation segments, methods, procedures, software interfaces, application program interfaces (API), instruction sets, computing code, computer code, code segments, computer code segments, words, values, symbols, or any combination thereof. In one implementation, for example, an article of manufacture may store executable computer program instructions that, when executed by a computer, cause the computer to perform methods and/or operations in accordance with the described implementations. The executable computer program instructions may include any suitable type of code, such as source code, compiled code, interpreted code, executable code, static code, dynamic code, and the like. The executable computer program instructions may be implemented according to a predefined computer language, manner or syntax, for instructing a computer to perform a certain operation segment. The instructions may be implemented using any suitable high-level, low-level, object-oriented, visual, compiled and/or interpreted programming language.

EXAMPLES

The following examples provide empirical data corresponding to various embodiments of electrolytic cells, which illustrate the reduction in power consumption realized by the present invention while also maintaining a sufficient degree of turbulence in the water flow to inhibit mineral scaling.

Example #1 (Prior Art)

One example of a known electrolytic cell has a production capacity of 4 kg/hr. In order to achieve this production rate while maintaining an output concentration of 2,000 mg/L, the generator electrochemical cell is operated at a flow rate of 8.8 GPM and a current of 4,000 A. Given the optimum spacing of approximately 8.40 mm between adjacent anodes and cathodes, a Reynolds number of approximately 35,700 has been observed. This cell operates at a power consumption of 6.0 kW/(kg/hr). It has been observed that, on average, this type of cell may be operated continuously for 12 days before a descaling procedure is needed.

Example #2

In an effort to reduce the overall size of the electrolytic cell to allow for installation in smaller spaces while maintaining the desired 2,000 mg/L output concentration, the inventors attempted to construct a cell having a 2 kg/hr production capacity. This capacity corresponds to a flow rate of 4.4 GPM and a current of 2,000 A. Given the extended cycle time before descaling observed in the known system of Example #1, the inventors maintained the electrode spacing of 8.40 mm which resulted in power consumption of 6.6 kW/(kg/hr). However, the inventors observed a reduced cycle time between descaling. Specifically, based on continuous operation, the 2 kg cell required descaling, on average, every 5 days. The inventors determined that a reduced Reynolds number of 17,900 was contributing to the decrease in operational time between descaling operations.

Example #3

The inventors then devised a new electrolytic cell having a 2 kg/hr capacity in which the flow rate remained at 4.4 GPM, and the current remained at 2,000 A, corresponding to the 2,000 mg/L design output concentration, but the electrode spacing was reduced to 4.15 mm. This setup resulted in a Reynolds number of 36,100. Notably, the inventors recognized that this embodiment provided a reduced power consumption with respect to the 2 kg cell of Example #2, specifically, 4.6 kW/(kg/hr).

Example #4

In an effort to confirm the scalability of the improvements recognized in the embodiment of Example #3, the inventors contemplated a cell having a 1 kg/hr capacity, with a flow rate of 2.2 GPM corresponding to a current of 1,000 A to yield a 2,000 mg/L output concentration. Given the lower flow rate, the inventors further reduced the spacing between the electrodes to 2.15 mm in order to maintain a sufficient Reynolds number of 34,900. This embodiment is expected to yield a further reduced power consumption of only 3.2 kW/(kg/hr).

While the inventors have deduced that further power savings may be achieved by decreasing the spacing between electrode pairs even further, practical considerations such as manufacturing tolerances and input water pollutants will tend to prevent even smaller cells, that also maintain the design relationships noted above (i.e., output concentration, Reynolds number, etc.), from being produced.

It should be appreciated that various sizes (i.e., capacities) of electrolytic cells may be constructed, and the illustrated examples of 1 kg and 2 kg are selected to be exemplary only. For example, cells having a 0.5 kg or 1.6 kg capacity (with electrode spacing adjusted accordingly) are also considered within the scope of the present invention.

While the foregoing has illustrated and described several embodiments in detail in the drawings and foregoing description, such illustration and description are to be considered as exemplary and not restrictive in character. For example, certain embodiments described hereinabove may be combinable with other described embodiments and/or arranged in other ways (e.g., process elements may be performed in other sequences). For example, devices may be added to facilitate hydrogen degassing at hypochlorite concentrations of 4,000 mg/L and higher. Accordingly, it should be understood that only a preferred embodiment and variants thereof have been shown and described and that all changes and modifications that come within the spirit of the disclosure are desired to be protected.

Example #5

A number of different test setups were developed to test the cooling requirement (in KWs) of a power supply operating a number of different electrolytic cells. In one example, an electrolytic cell designed to operate at 4,000 A was tested at various voltage outputs of a supply rectifier. In addition, a pair of 2,000 A cells were also tested when operated in tandem and supplied electrical power serially. Each cell or group of cells were operated at a flow rate of 8 GPM or more. For the 4,000 A cell, the cooling requirement was 9.4 KW when operated at 36V, 8.87 KW when operated at 24 V, and 8.73 KW when operated at 12 V. In contrast, the 2,000 A cell arrangement required only 4.84 KW when operated at 36 V. Thus, it was demonstrated that the heat rejection factor for a rectifier scaled with current rather than voltage. In turn, relatively low current cells operating at higher voltages in series, provided energy efficiencies as noted above.

What is claimed is:

1. A hypochlorite generation system, comprising:

an electrolytic cell comprising:

a plurality of annular electrolytic channels that are coaxially disposed about an axis of the electrolytic cell to be concentric relative to the axis, the electrolytic channels extending along a length of the electrolytic cell relative to the axis, wherein each annular electrolytic channel is fluidly connected to an adjacent concentrically disposed annular electrolytic channel, and wherein each electrolytic channel comprises a cathode surface and an anode surface defining a channel volume therebetween, a surface-to-surface spacing between the cathode surface and the anode surface being not less than 1.5 mm and not greater than 8.0 mm, and a fluid flow path extending from an input of the electrolytic cell through the channel volume of each concentrically disposed annular electrolytic channel to an output of the electrolytic cell, the fluid flow path extending in a direction of increasing radial dimension relative to the annular electrolytic channels;

a flow controller operative to control a flow rate of saltwater through the electrolytic cell along the fluid flow path, wherein the flow controller controls the flow rate of the saltwater through the electrolytic cell to be not less than 0.35 $m^3$/hr and not greater than 1.9 $m^3$/hr; and a power supply operative to provide an electrical current between the cathode members and the anode members of not less than 200 A and not greater than 3,700 A;

wherein the electrolytic cell is operative to output a sodium hypochlorite concentration in the saltwater at the outlet of not less than 1,800 mg/L based on the flow rate and the electrical current.

2. The hypochlorite generation system of claim 1, further comprising:

a finite supply volume of saltwater to be passed through the electrolytic cell, wherein the finite supply volume of saltwater is limited by at least one of a supply volume restriction or a destination volume restriction.

3. The hypochlorite generation system of claim 2, wherein the outlet is adapted to be in fluid communication with a destination tank to be filled by the saltwater comprising sodium hypochlorite in the saltwater from the output of the electrolytic cell.

4. The hypochlorite generation system of claim 3, wherein the destination tank comprises a ballast water tank of a ship.

5. The hypochlorite generation system of claim 1, wherein the input of the electrolytic cell is in fluid communication with a source of untreated water and the output comprises a treated water stream comprising water from the source and the sodium hypochlorite generated by the electrolytic cell.

6. The hypochlorite generation system of claim 5, wherein the source of untreated water comprises a eutrophic or ammonia contaminated water source, and wherein the treated water stream comprises sodium hypochlorite at a concentration above a breakpoint chlorination level for the treated water.

7. The hypochlorite generation system of claim 1, wherein the power supply provides a uniform anodic surface current density.

8. The hypochlorite generation system of claim 7, wherein the uniform anodic surface current density is not less than 0.090 A/$cm^2$ and not greater than 0.130 A/$cm^2$.

9. The hypochlorite generation system of claim 1, wherein the electrical current between the cathode members and the anode members is not greater than 1,500 A.

10. The hypochlorite generation system of claim 1, wherein:

the surface-to-surface spacing between the cathode surface and the anode surface is not less than 3.0 mm and not greater than 7.5 mm, and the flow controller controls the flow rate of the saltwater through the electrolytic cell to be not less than 0.75 $m^3$/hr and not greater than 1.75 $m^3$/hr; and the electrical current between the cathode members and the anode members is not less than 1500 A and not greater than 3,500 A.

11. The hypochlorite generation system of claim 1, wherein:

the surface-to-surface spacing between the cathode surface and the anode surface is 4.15 mm, and the flow controller controls the flow rate of the saltwater through the electrolytic cell to be 1.0 $m^3$/hr; and the electrical current between the cathode members and the anode members is 2,000 A.

12. The hypochlorite generation system of claim 1, further comprising:

a plurality of the electrolytic cells of claim 1, wherein the flow controller is operative to control the flow rate of saltwater through the plurality of electrolytic cells and the power supply is operative to provide electrical current to the plurality of electrolytic cells.

13. The hypochlorite generation system of claim 12, wherein the power supply comprises an alternating current (AC) to direct current (DC) rectifier.

14. The hypochlorite generation system of claim 13, wherein the plurality of electrolytic cells are electrically arranged in series.

15. The hypochlorite generation system of claim 13, wherein the plurality of electrolytic cells are arranged in parallel.

16. A hypochlorite generation system, comprising:

a power supply comprising an alternating current (AC) to direct current (DC) rectifier;

a flow controller operative to control a flow of water through the system;

a controller in operative communication with the power supply and the flow controller to control the operation thereof; and a plurality of electrolytic cells, each electrolytic cell comprising:

a plurality of annular electrolytic channels that are coaxially disposed about an axis of the electrolytic cell to be concentric relative to the axis, the electrolytic channels extending along a length of the electrolytic cell relative to the axis, wherein each annular electrolytic channel is fluidly connected to an adjacent concentrically disposed annular electrolytic channel, and wherein each electrolytic channel comprises a cathode surface and an anode surface defining a channel volume therebetween, a surface-to-surface spacing between the cathode surface and the anode surface being not less than 1.5 mm and not greater than 8.0 mm, and a fluid flow path extending from an input of the electrolytic cell through the channel volume of each concentrically disposed annular electrolytic channel to an output of the electrolytic cell, the fluid flow path extending in a direction of increasing radial dimension relative to the annular electrolytic channels, wherein the controller is operative to apply a direct electrical current from the power supply to the electrolytic cell between the cathode members and anode members of not less than 200 A and not greater than 3,700 A.

17. The hypochlorite generation system of claim 16, wherein hypochlorite is generated by the plurality of electrolytic cells at a rate of 4 kg/hr and a concentration of not less than 1,500 mg/L.

18. A method of operation of an electrolytic cell, comprising:

controlling a flow rate of saltwater through an electrolytic cell to be not less than 0.35 $m^3$/hr and not greater than 1.9 $m^3$/hr, the electrolytic cell comprising:

a plurality of annular electrolytic channels that are coaxially disposed about an axis of the electrolytic cell to be concentric relative to the axis, the electrolytic channels extending along a length of the electrolytic cell relative to the axis, wherein each annular electrolytic channel is fluidly connected to an adjacent concentrically disposed annular electrolytic channel, and wherein each electrolytic channel comprises a cathode surface and an anode surface defining a channel volume therebetween, a surface-to-surface spacing between the cathode surface and the anode surface being not less than 1.5 mm and not greater than 8.0 mm, and a fluid flow path extending from an input of the electrolytic cell through the channel volume of each concentrically disposed annular electrolytic channel to an output of the electrolytic cell, the flow path extending in a direction of increasing radial dimension relative to the annular electrolytic channels;

applying an electrical current to the electrolytic cell between the cathode members and anode members of not less than 200 A and not greater than 3,700 A; and generating sodium hypochlorite in the electrolytic cell by an electrolysis reaction at the cathode members in the presence of the saltwater and applied electrical current, wherein the sodium hypochlorite is generated at a concentration of greater than 1,800 mg/L based on the flow rate and the electrical current.

19. The method of claim 18, wherein the electrical current applied to the electrolytic cell between the cathode members and the anode members is not greater than 1,500 A.

* * * * *